US005768957A

United States Patent [19]

Baker

[11] Patent Number: 5,768,957

[45] Date of Patent: Jun. 23, 1998

[54] RATCHET TOOL

[76] Inventor: Rodney William Baker, 23 Penrod Dr., Bell Block, Taranaki, New Zealand

[21] Appl. No.: 596,340

[22] PCT Filed: Aug. 25, 1994

[86] PCT No.: PCT/NZ94/00086

§ 371 Date: Apr. 24, 1996

§ 102(e) Date: Apr. 24, 1996

[87] PCT Pub. No.: WO95/05923

PCT Pub. Date: Mar. 2, 1995

[30] Foreign Application Priority Data

Aug. 25, 1993 [NZ] New Zealand ..... 248500

[51] Int. Cl.[6] ..... B25B 13/46

[52] U.S. Cl. ..... 81/57.39; 81/383; 74/105

[58] Field of Search ..... 81/57.39, 58, 58.1, 81/342, 381, 383; 74/102, 105, 128

[56] References Cited

U.S. PATENT DOCUMENTS 1,709,378 4/1929 Sulger ..... 81/383
2,708,383 5/1955 Herbst et al. ..... 81/57.39
2,726,563 12/1955 Blackburn .
4,323,009 4/1982 Volgt ..... 74/105
4,507,989 4/1985 Baker ..... 81/57.39

FOREIGN PATENT DOCUMENTS 95317 11/1959 Norway ..... 81/383

*Primary Examiner*—D. S. Meislin
*Assistant Examiner*—Joni B. Danganan

[57] ABSTRACT

A hand tool comprising a housing 1 with a ratchet wheel 2 in one end of the housing 1 and a lever assembly mounted on the housing adjacent the other end of the housing. The lever assembly comprises two linkages 23,24 pivotably attached to a lever 21 and to a mounting bracket 25. A rod 5 is disposed axially in the housing 1. A link chain 6 and ratchet tooth 7 are connected to the other end of the rod 5 about the ratchet wheel 2. The lever 21 is attached to the end of the rod 5 to form a ball socket. When the lever 21 is squeezed, the end portion 22 of the lever 21 pulls the rod 5 substantially straight outwards from the housing 1 which pulls the link chain 6 and ratchet tooth 7 on the ratchet wheel 2 to rotate the ratchet wheel 2.

16 Claims, 6 Drawing Sheets

RATCHET TOOL

TECHNICAL FIELD

This invention relates to hand tools. More particularly, but not exclusively, this invention relates to a ratchet tool with a lever mechanism comprising a lever and linkage configuration adapted to increase the mechanical advantage of a rotating ratchet wheel.

BACKGROUND OF THE INVENTION

There are many situations in the service and manufacturing industries, and elsewhere, where a hand tool is required to rotate an object to which direct access may not be possible. The use of a spanner may be difficult to operate as the radial movement of the spanner requires free space to effect turning of a nut or bolt.

A known type of ratchet tool consists of a ratchet wheel with a toothed rim mounted in one end of an elongate housing with a pawl mounted adjacent the ratchet wheel and extending against the toothed rim. The elongate housing is rotated about the ratchet wheel in one direction to loosen or tighten a nut. The mechanical action of these ratchet tools also requires space around the nut area to effect turning of the ratchet wheel. This may be difficult in confined spaces, which results in either not being able to rotate the ratchet tool or only being able to turn the nut in small incremental degrees.

Another known ratchet tool is that described in New Zealand patent specification No. 198861/199602. That ratchet tool has a handle mechanism comprising a lever with one pivot joint and attached to a plunger. The plunger is connected to a drive mechanism which drives a ratchet wheel. When the lever is squeezed, the longitudinal movement of the plunger translates into a rotary motion of the ratchet wheel. A limitation with this handle mechanism is that much force is required by a user to operate the handle and apply torque to loosen or tighten a nut.

DISCLOSURE OF THE INVENTION

It is an object of the invention to overcome at least some of the these disadvantages or at least to provide the public with a useful choice.

According to one aspect of the invention there is provided a lever assembly for converting lateral motion of a handle end of a lever means into reciprocating motion of a distal end of the lever means comprising a mounting means to fix the lever assembly to a position where reciprocating motion is required, the lever means comprising the handle end adapted to permit manual gripping and adapted to be movable under manual pressure toward the mounting means and a reciprocating portion of the distal end of the lever means at a distal position, first and second linkage means spaced apart from each other and pivotably mounted between the handle end of the lever means and the mounting means in substantially the same plane so that four pivot points form the corners of a four sided figure, the first linkage means being pivotably connected closer to the distal end of the lever means than the second linkage means, the length of the sides and the relationship between the lever means and the mounting means providing reciprocal motion at the distal end of the lever means.

According to a further aspect of the invention there is provided a method of attaching the lever assembly to a hand tool comprising the steps of:

(i) inserting a ball on the distal end of a rod in a socket provided on the distal end of the lever means; and (ii) extending the rod outwards from the housing enough to allow the mounting bracket to be positioned in place about the housing.

According to a further aspect of the invention there is provided a method of detaching the lever assembly from a hand tool comprising the steps of:

(i) extending the rod outwards from the housing enough to allow the mounting bracket to be removed from about the housing; and (ii) removing a socket provided on the distal end of the lever means from a ball on the distal end of the rod to remove the lever assembly from the hand tool.

BRIEF DESCRIPTION OF THE DRAWINGS

The invention will now be described by way of example with reference to the accompanying drawings in which.

BEST MODE FOR CARRYING OUT THE INVENTION

Figure 1:
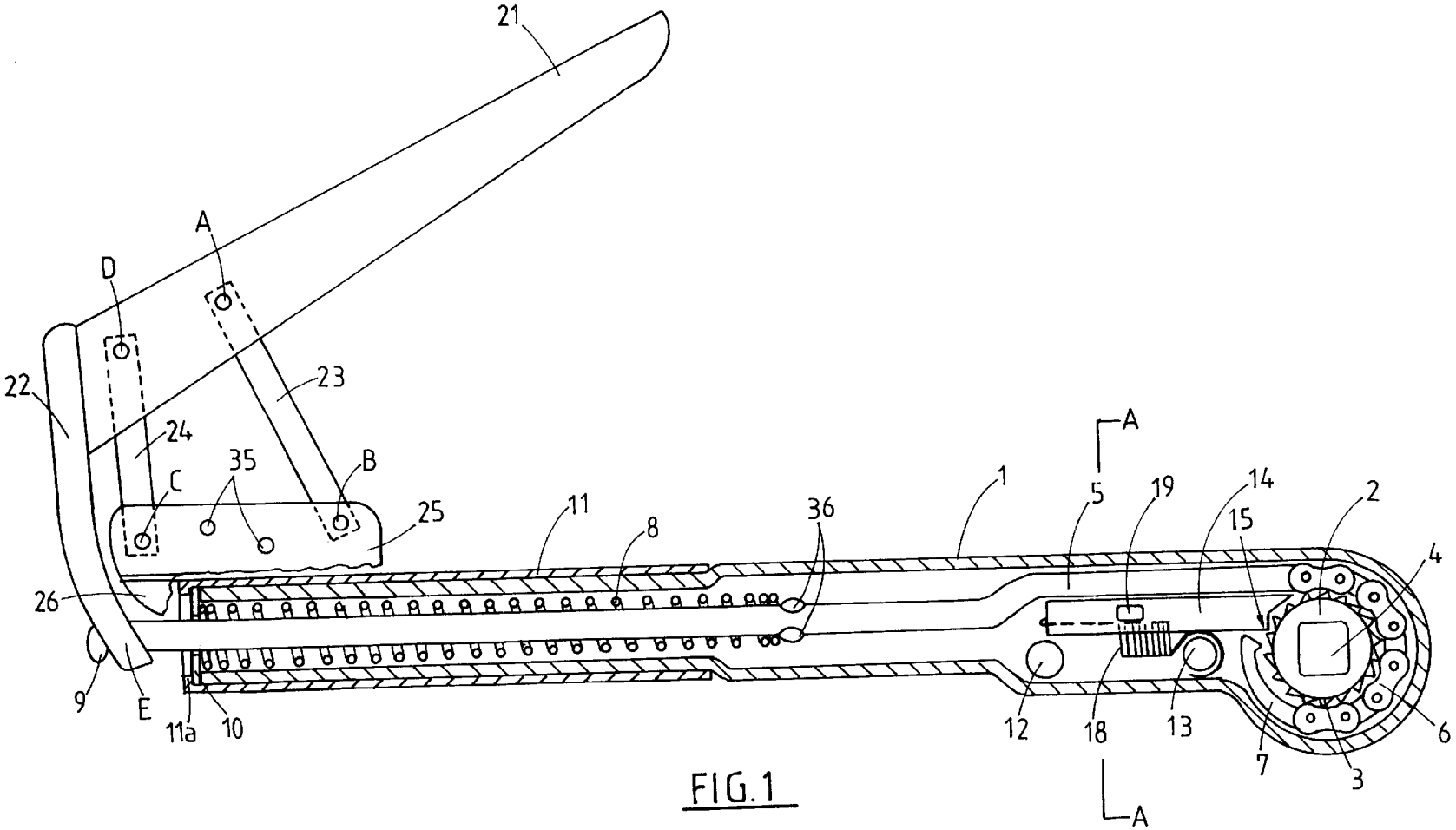
FIG. 1. shows a cross-sectional view of a ratchet tool through the housing and sleeve according to a preferred embodiment of the invention.
Figure 7:
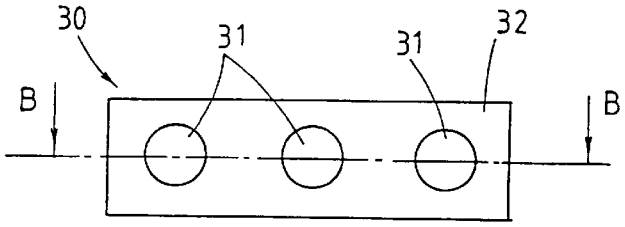
FIG. 7. shows a view of a square drive peg.
Figure 9:
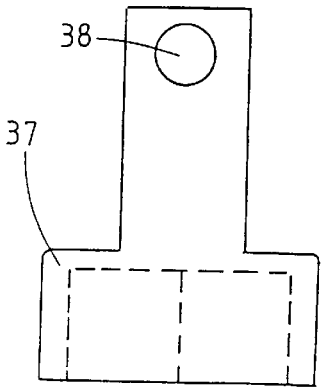
FIG. 9. shows a side view of a low profile socket.

Referring to FIG. 1, a cross-sectional view of a ratchet tool with the lever assembly partially attached is described. A tubular housing 1 is constructed by cold pressing matching halves from sheet steel. A ratchet wheel 2 is retained in one end of the tubular housing 1. Teeth 3 protrude from around the rim of the ratchet wheel 2. An aperture 4 about the centre axis of ratchet wheel 2 is preferably a square hole to retain a square drive peg 30 (as shown in FIG. 7) or a low profile socket 37 (as shown in FIG. 9).

A rod 5 is connected to a link chain 6 which extends about the ratchet wheel 2. A ratchet tooth 7 is preferably connected to the end of the link chain 6 and has an extending portion which engages the teeth 3 on the ratchet wheel 2 when the rod 5 is pulled.

A return bias means, preferably a compression spring 8, is fitted about the rod 5 with the smaller diameter end abutted against pinched ears 36 on the middle section of rod 5. The larger diameter end may be secured at the open end of housing 1 by a washer 10 to provide a return bias to the rod 5. The rim of the washer 10 may be retained by the rolled in end portion 11*a* of the sleeve 11. Alternatively, the larger diameter end of the compression spring 8 may be retained by an internal rim formed on the sleeve 11 by rolling over the end of sleeve 11, thus eliminating the washer 10.

Sleeve 11 is pressed firmly over housing 1 to secure together the cold pressed matching tubular halves of the housing 1. The housing 1 may also be held together by rivets 12, 13 through the housing 1.

The mounting bracket 25 is preferably constructed from two halves of pressed steel plate shaped to extend about opposite sides of sleeve 11 and project from the sleeve 11 to form a bracket to fix linkages 23, 24 at pivot points B, C respectively between the two halves of the bracket 25. Rivets or pins fasten the linkages between the halves of the bracket 25. Rivets 35 may be fitted with sleeves (not shown) between the halves of the bracket 25 to increase the robustness of the mounting bracket 25.

The lever 21 is preferably shaped to form a channel to envelop the other ends of linkages 23, 24 to allow rivets or pins to fasten the linkages 23,24 between the lever at pivot points A and D respectively.

Figure 2:
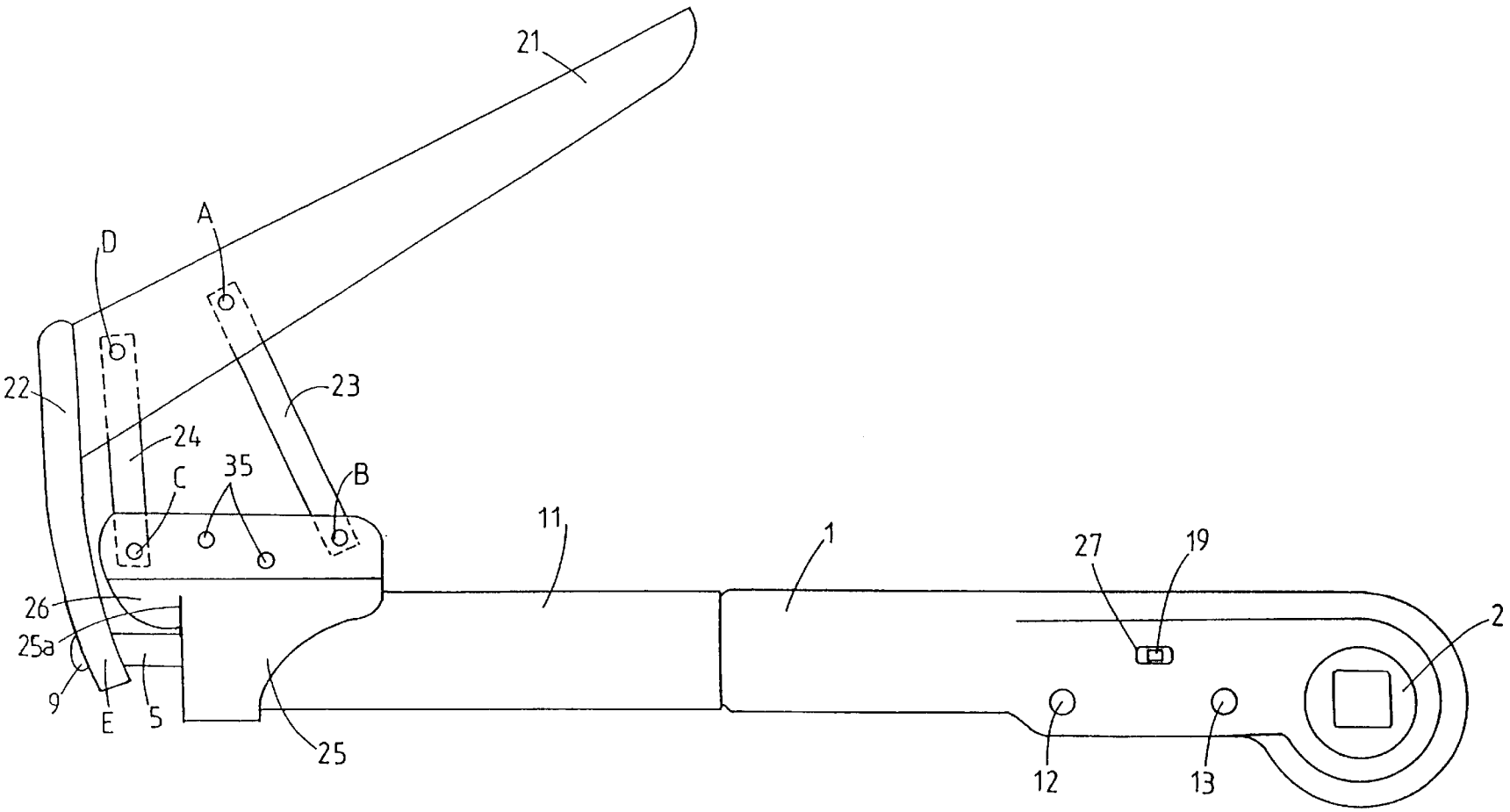
FIG. 2. shows a side view of a lever assembly and ratchet tool according to a preferred embodiment of the invention.

Referring to FIG. 2, a side view of a lever assembly and ratchet tool is shown. The tubular housing 1 is moulded in steel or any other suitable material to envelop and retain the working parts inside the tool. Slots 27 are made on either side of the housing 1 to properly position the wedge-shaped portion 15 of master pawl 14 (not shown) for longitudinal movements onto and away from the teeth 3 about ratchet wheel 2.

A lever assembly comprising of a lever 21 and linkage arms 23,24 is mounted on a bracket 25. The mounting bracket 25 is fitted loosely about the circumference of the sleeve 11 to allow a user to swivel the handle radially about housing 1 to obtain an optimum working position with the tool. A tab 26 is turned in to form a shoulder 25*a* to abut the mounting bracket 25 against the sleeve 11.

The lever assembly comprises a lever 21 shaped with an angled end portion 22. Rod 5 projects outwardly from the tubular housing 1. The end of the rod 5 extending from the housing 1 is shaped as a ball 9.

The spaced relationship between the pivot points A,B,C, D, more particularly the distance between the pivot points in each linkage 23, 24 and the distance between the linkage pivot points in the lever and mounting bracket, are an essential feature of the lever assembly.

The four pivot points can be seen to form a four sided figure. It is to be appreciated the dimension between any two adjoining pivot points will always be relative to the dimensions between the other adjoining pivot points. The longest dimension is always between pivot points AB of linkage 23. The second longest dimension is always between pivot points BC on the mounting bracket 25. The third longest dimension is always between pivot points CD of linkage 24. The shortest dimension is always between pivot points AD on the lever 21.

The approximate dimensions between the pivot points A,B,C,D of a preferred embodiment of the lever assembly are as follows:

Dimension between pivot points AB= about 40.5 mm
Dimension between pivot points BC= about 34.5 mm
Dimension between pivot points CD= about 31 mm
Dimension between pivot points AD= about 19 mm The length of travel of the rod from the housing is about 46 mm when the lever is squeezed between the fully extended position to the fully contracted position.

It is to be appreciated that these dimensions are applied to the preferred embodiment of the invention as described herein and that variations of these dimensions and proportional adjustments to the dimensions are possible without departing from the scope of the invention.

Figure 4:
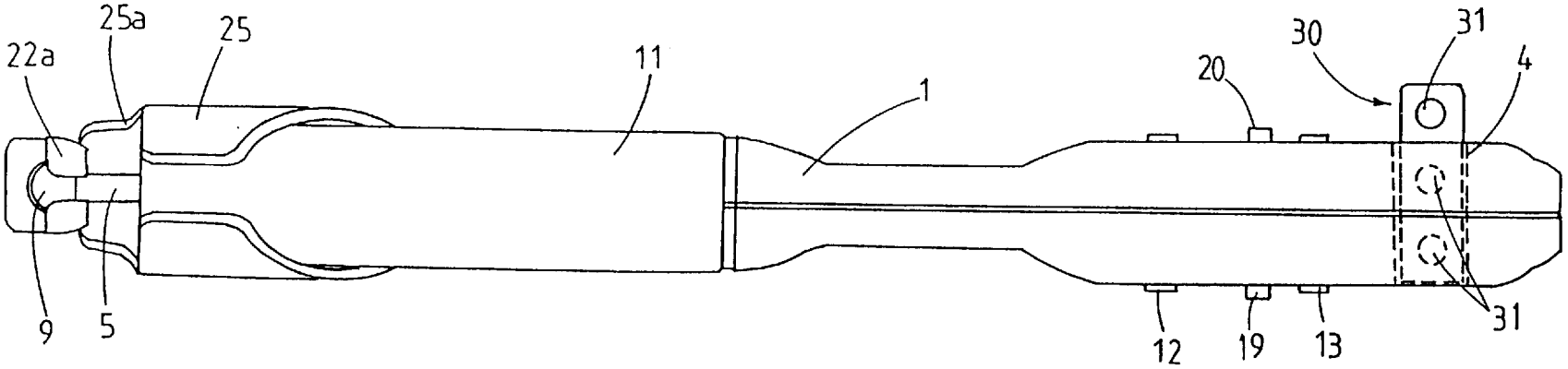
FIG. 4. shows a bottom view of the lever assembly on a ratchet tool.

Referring to FIGS. 1,2 and 4, projections 19, 20; extend from the master pawl 14 through respective slots 27 in the tubular housing 1 and function to retain the correct positioning of master pawl 14 in the tubular housing 1 against the teeth 3 of the ratchet wheel 2. A user may manually retract the master pawl 14 from the ratchet wheel by pulling the projection 19 or 20 or both away from the ratchet wheel 2 to allow the ratchet tooth 7 to freely rotate the ratchet wheel 2 in both directions.

Figure 3:
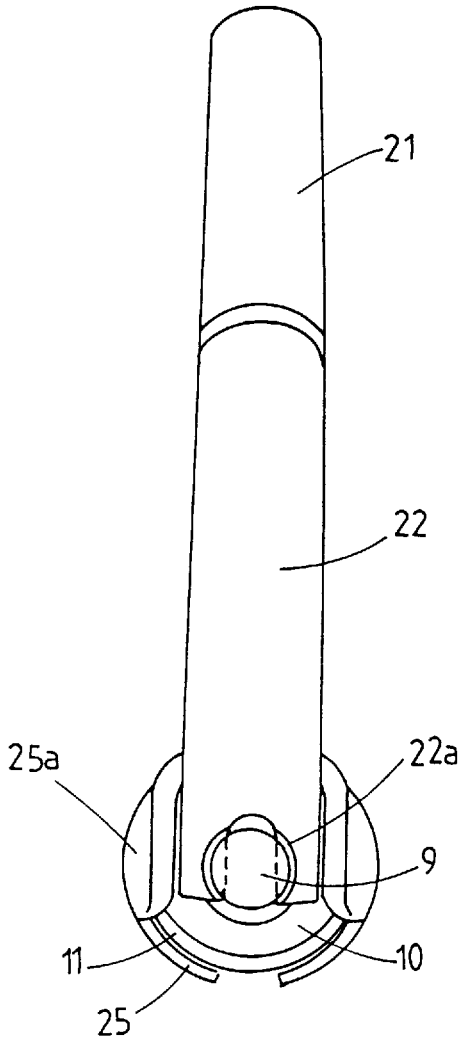
FIG. 3. shows an end view of the lever assembly on a hand tool.

Referring to FIG. 3, an end view of the lever assembly and ratchet tool is described. A slot is preferably cut from the end portion 22 of lever 21 to a width just wider than the diameter of rod 5. A portion of the slot is drilled out to a diameter just wider than the ball end 9 to form a socket 22*a*. The ball end 9 of the rod 5 is retained in the socket 22*a* during use.

The mounting bracket 25 may be retained in place by the tension on the rod 5 from the compression spring 8 forcing the shoulder 25*a* of the bracket 25 against the end of the sleeve 11.

The lever assembly may be attached to the ratchet tool by inserting the ball end 9 of the rod 5 into the socket 22*a* located in the end portion 22 of lever 21, and then extending the rod 5 outwards from the housing 1 far enough to allow the mounting bracket 25 to slip over sleeve 11.

The lever assembly may be detached from the hand tool by extending the rod 5 outwards from the housing 1 to allow the mounting bracket 25 to be removed from the housing 1, and then removing the socket 22*a* from the ball end 9 of the rod 5 to remove the lever assembly from the ratchet tool.

Referring to FIG. 4, a view of the underside of the mounting bracket 25 and ratchet tool is shown. The mounting bracket 25 is preferably shaped to the outer diameter of the sleeve 11. The mounting bracket 25 does not completely envelop the sleeve 11 but a gap of at least slightly larger than the diameter of rod 5 is allowed to ease the mounting bracket 25 over the rod 5 during attachment and back over the rod 5 during detachment of the lever assembly on the ratchet tool.

Figure 5:
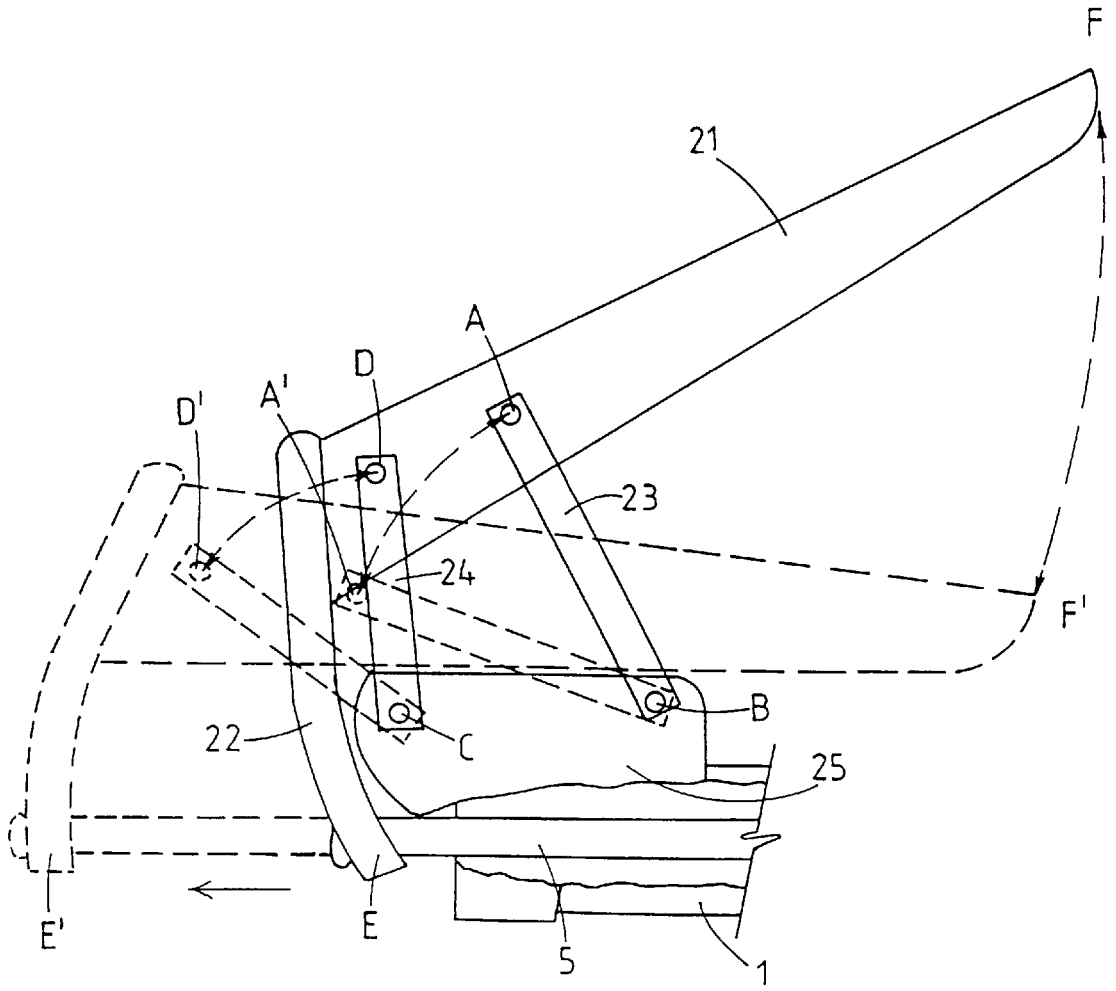
FIG. 5. shows a diagram of the opening and closing action of the lever assembly.

Referring to FIG. 5, a diagram showing the action of the lever assembly is described. The solid lines show the lever mechanism in the extended position and the dotted outline shows the lever assembly in the compressed position.

When the lever 21 is squeezed to move in an arc between F–F', pivot point A travels in an arc between A–A' and pivot point D travels in an arc between D–D'. Pivot points B and C are fixed.

It is seen that this action results in the angled end portion 22 of the lever 21 at point E pulling the rod 5 from the housing 1 in a substantially straight line between E–E'. The linkages 23,24 are seen to collapse to move the lever end portion 22 in the desired direction.

This lever action eliminates the need for a second ball joint at the other end of rod 5. Furthermore, the need for a rack and pinion to increase the travel of the ratchet tooth 7 is eliminated, thus simplifying the mechanical action of the tool and reducing the diameter of the housing 1.

Figure 6:
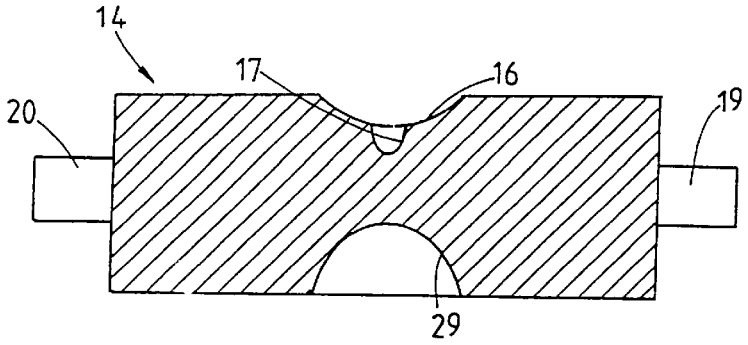
FIG. 6. shows a cross-sectional view of the master pawl through section A—A as indicated on FIG. 1.

Referring to FIG. 6, a master pawl 14, preferably blanked or cast out of high grade steel, may comprise a fluted groove 16 into which a portion of the rod 5 reciprocates back and forward. The fluted groove 16 allows extra clearance for the rod 5 to prevent the rod 5 from dragging against the master pawl 14.

Another fluted groove 17 may be provided in the master pawl 14 to hold one hooked end of tension spring 18. The coiled portion of tension spring 18 may be nestled in a second groove 29 of the master pawl 14 and the other hooked end around rivet 13. The tension spring 18 allows for a direct pulling effect with the return of the master pawl 14 to the ratchet wheel 2.

The master pawl 14 may have a wedge-shaped portion 15 designed to maximise the load bearing surface area at which the master pawl presses against a shoulder of tubular housing 1 and withstand high torque loads present with the initial loosening and final tightening of a nut or bolt.

Figure 8:
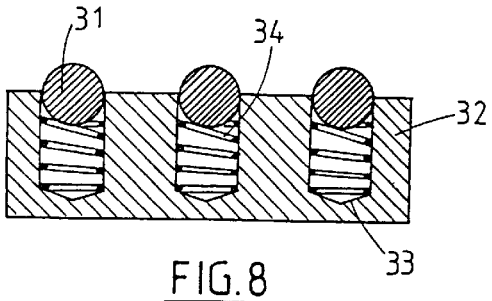
FIG. 8 shows a cross-sectional view of the square drive peg through section B—B as indicated in FIG. 7.

Referring to FIGS. 7 and 8, a square drive peg 30 is shown. The body portion 32 of the peg is preferably made of high grade steel and shaped to slide through the aperture 4 in the ratchet wheel 2. Three holes 33 are cast or drilled in the body portion 32. Springs 34 are retained in the hole 33 to spring-load the ball bearings 31.

Two rows of indents (not shown) are preferably made in the aperture 4 of the ratchet wheel 2 to retain the square peg 30 in place while in use. In use, two of the ball bearings are located by indents inside the ratchet wheel 2 and the third ball bearing retains a socket or attachment (not shown). The spring-loaded ball bearings function to press into corresponding indents in the aperture 4 to hold the square peg 30 in position.

Referring now to FIGS. 1 and 4, the square peg 30 is seen to project from the aperture 4 of ratchet wheel 2. Two of the ball bearings 31 are located within the aperture 4. As the ratchet wheel 2 only rotates in one direction when in use, the square peg 30 is designed to be pushed through the aperture 4 to extend one of the ball bearings 31 out the other side of the ratchet tool. This reverses the direction of rotation of the square peg, thus allowing the ratchet tool to be used to rotate a nut or bolt in both directions.

Referring to FIGS. 1 and 9, a low profile socket 37 is described. The low profile socket 37 may be used with the ratchet tool as an alternative means to rotate a nut or bolt than with using the square drive peg 30 and standard socket in situations where a narrow space around the nut or bolt head prevents use of the square peg 30 and standard socket.

The low profile socket 37 is sized at the ball bearing end 38 to fit in the aperture 4 of the ratchet wheel 2. The ball bearing 38 locates the furthest of two indents in one side of the aperture 4 from the entry end of the aperture 4 before use.

In operation, a socket or attachment is retained over one of the ball bearings adjacent either end of the square peg 30. The square peg 30 is slotted through aperture 4 and indents in aperture 4 locate the remaining two ball bearings to retain the square peg 30. Alternatively, the low profile socket 37 may be slotted into the aperture 4. The ratchet tool is then placed over the object to be rotated.

The lever 21 is squeezed toward tubular housing 1, causing linkages 23, 24 to fold with pivot pins A, D moving rearwards with the angled end portion 22 of lever 21 moving outwardly moving rod 5 outwardly from the tubular housing 1. This action pulls link chain 6 which in turn pulls ratchet tooth 7 to engage the teeth 3 of ratchet wheel 2 and rotate ratchet wheel 2 to loosen or tighten the object retained in the socket.

When lever 21 is released by the user, compression spring 8 expands to force rod 5 to disengage ratchet tooth 7 from the teeth 3 around ratchet wheel 2 and retract rod 5 in toward the housing. This return bias also raises the linkages 23, 24 and lever 21 back to an extended position.

The hand tool may assist a user to tighten or loosen a nut or bolt. This hand tool is particularly useful when the nut or bolt is located in a confined space.

An advantage with this invention is that the lever 21 retracts away from the ratchet wheel 2 when squeezed which reduces the possibility of the lever 21 being obstructed when the tool is being used in a confined space.

It will be appreciated the lever assembly may be removed from the housing and the tool may be used as a conventional ratchet tool.

Where in the foregoing description reference has been made to integers or components having known equivalents then such equivalents are herein incorporated as if individually set forth.

Although this invention has been described by way of example it is to be appreciated that modifications may be made thereto without departing from the scope of the invention as defined in the appended claims.

Industrial Applicability

Although the apparatus of the invention may find application in a wide variety of hand tools, the invention is considered particularly suitable for use as a ratchet tool for tightening or loosening nuts and bolts located in confined spaces.

I claim:

1. A lever assembly for converting lateral motion of a handle of a lever means into reciprocating motion of a distal end of the lever means comprising:

a mounting means to secure the lever assembly at a position where reciprocating motion is required, the lever means comprising the handle adapted to permit manual gripping and adapted to be movable under manual pressure towards the mounting means and a reciprocating portion of the distal end of the lever means at a distal position, first and second linkage means spaced apart from each other and pivotably mounted between the handle of the lever means and the mounting means in substantially the same plane so that four pivot points form the corners of a four sided figure, the first linkage means being pivotably connected closer to the distal end of the lever means than the second linkage means, the length of the sides and the relationship between the lever means and the mounting means providing reciprocal motion at the distal end of the lever means wherein the longest side of the four sided figure is between the pivot points of the second linkage means, the second longest side is between the pivot points of the first and second linkage means connected to the mounting means, the third longest side is between the pivot points of the first linkage means and the shortest side is between the pivot points of the first and second linkage means connected to the handle of the lever means, the distal end of the lever means being adapted to be connected to a rod extending from a tool engaged with the mounting means, the lever assembly including a return bias means fitted to the rod to apply a return bias to the rod and wherein the mounting means is an elongate housing, and the rod is disposed in the housing, the arrangement being such that lateral motion of the handle end of the lever means will impart a reciprocal motion of the rod in the housing.

2. A lever assembly according to claim 1 wherein the return bias means is a compression spring fitted co-axially about the rod.

3. A lever assembly according to claim 2 wherein the compression spring is conical in shape.

4. A lever assembly according to claim 1 wherein the pivot points connected to the mounting means of the first and second linkage means are located on a mounting bracket, and the mounting bracket is adapted to be fitted about the housing.

5. A lever assembly according to claim 4 wherein one end of the housing adjacent the lever means is circular in shape, and the mounting bracket is adapted to swivel about the one end of the housing.

6. A lever assembly according to claim 5 wherein the mounting bracket is shaped with a tab at the lever end of the mounting bracket to form a shoulder which abuts against the one end of the housing.

7. A lever assembly according to claim 5 wherein the distal end of the lever means connected to the rod is provided with a socket, and the end of the rod extending from the one end of the housing is provided with a ball, the arrangement being such that the ball end of the rod is retained in the socket and allows the lever assembly and the mounting bracket to swivel about the housing.

8. A lever assembly according to claim 1 wherein the longest side is substantially 40.5 mm, the second longest side is substantially 35.5 mm, the third longest side is substantially 31 mm, and the shortest side is substantially 19 mm.

9. A lever assembly as claimed in claim 1 incorporating a rotatable member mounted in the other end of the housing, a drive mechanism connecting the other end of the rod to the rotatable member, the arrangement being such that movement of the handle end of the lever means towards the housing will impart a substantially longitudinal movement of the rod from the housing which is translated into a rotational movement of the rotatable member.

10. A lever assembly according to claim 9 wherein the drive mechanism comprises a link chain connected to a ratchet tooth, the rotatable member is a ratchet wheel with teeth about the rim of the ratchet wheel, the arrangement being such that the ratchet tooth is retracted by the link chain to engage the teeth to rotate the ratchet wheel when the rod is extended outwardly by operating the lever assembly.

11. A lever assembly according to claim 10 wherein a pawl is fitted inside the housing and adapted to restrict rotation of the ratchet wheel in one direction.

12. A lever assembly according to claim 11 wherein the ratchet wheel is provided with an aperture located about and through the centre axis of the ratchet wheel.

13. A lever assembly according to claim 12 wherein the pawl is fitted with a second return bias means to apply a return bias of the pawl to the teeth about the ratchet wheel.

14. A lever assembly according to claim 13 wherein the aperture about the centre axis of the ratchet wheel is a square hole.

15. A lever assembly according to claim 14 wherein the square hole in the ratchet wheel is adapted to retain a corresponding square peg, the square peg being adapted to retain an attachment means, and the attachment means being adapted to retain a rotatable object.

16. A lever assembly according to claim 15 wherein a socket is provided with a square end portion adapted to slide through the square hole in the ratchet wheel.

* * * * *